US006329751B2

(12) United States Patent
Yoo

(10) Patent No.: US 6,329,751 B2
(45) **Date of Patent: *Dec. 11, 2001**

(54) PLASMA DISPLAY PANEL WITH UV REFLECTING LAYERS

(75) Inventor: Min-sun Yoo, Suwon (KR)

(73) Assignee: Samsung Display Devices Co., Ltd., Kyungki-Do (KR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/143,347

(22) Filed: Aug. 28, 1998

(30) Foreign Application Priority Data

Aug. 30, 1997 (KR) ..... 97-44397

(51) Int. Cl.[7] ..... H01J 17/49; H01J 1/62; H01J 63/04

(52) U.S. Cl. ..... 313/582; 313/587

(58) Field of Search ..... 313/485, 582, 313/509, 585, 586, 587, 484

(56) References Cited

U.S. PATENT DOCUMENTS 4,224,553 9/1980 Hellwig .
4,803,402 * 2/1989 Raber et al. ..... 313/509
4,827,186 * 5/1989 Knauer et al. ..... 313/485
5,182,489 1/1993 Sano .
5,780,174 * 7/1998 Tokito et al. ..... 428/690
6,008,580 * 12/1999 Nakamura et al. ..... 313/568

FOREIGN PATENT DOCUMENTS 35 27 884 2/1986 (DE) .
0 284 138 9/1988 (EP) .
4-332430 11/1992 (JP) .
5-80390 11/1993 (JP) .

* cited by examiner

*Primary Examiner*—Nimeshkumar D. Patel
*Assistant Examiner*—Karabi Guharay
(74) *Attorney, Agent, or Firm*—Lowe Hauptman Gilman & Berner, LLP

(57) ABSTRACT

A plasma display panel includes front and rear substrates coupled to face each other, a partition formed between the front and rear substrates to define a discharge space, a discharger for generating parent light rays by discharging gas filled in the discharge space, a fluorescent layer, formed in a predetermined pattern in the discharge space, for emitting light by being excited by the parent light rays, and a reflection film, formed in an area where the fluorescent layer is not formed in the discharge space, for reflecting the parent light rays toward the fluorescent layer.

5 Claims, 3 Drawing Sheets

PLASMA DISPLAY PANEL WITH UV REFLECTING LAYERS

BACKGROUND OF THE INVENTION

1. Field of the Invention

The present invention relates to a plasma display panel in which a fluorescent layer emits light to form an image by receiving ultraviolet light generated during gas discharge.

2. Description of the Related Art

A plasma display panel has been widely known as a flat type display panel, equivalent in quality to a cathode ray tube, due to its capacity to display large amounts of data, it's a wide viewing angle, and superior brightness and contrast features.

In general, the plasma display panel is divided into a DC plasma display panel and an AC plasma display panel according to its operation principle. The DC plasma display panel has all electrodes exposed to a discharge space in which charges move directly between opposite electrodes. While, in the AC plasma display panel, at least one electrode is coated with a dielectric and discharge is generated by the electric field of wall-charges.

Also, the plasma display panel is divided into an opposed discharge type and a surface discharge type according to the composition of electrodes. In the opposed discharge type plasma display panel, an address electrode and a scanning electrode are installed at each unit pixel to face each other and an addressing discharge for selectively discharging a desired pixel and a sustaining discharge for sustaining the addressing discharge are generated between the two opposed electrodes.

In the surface discharge type plasma display panel, however, each unit pixel is provided by a scanning electrode and a common electrode opposing an address electrode. Addressing and sustaining discharges are generated between the address electrode and the scanning electrode, and the scanning electrode and the common electrode, respectively.

Ultraviolet light generated during discharge in the plasma display panel allows a fluorescent layer disposed in a discharge space to emit light, so that an image is formed.

FIG. 1 shows an example of a conventional plasma display panel.

As shown in the drawing, the conventional plasma display panel includes a substrate 10, a first electrode 11 formed on the substrate 10, a dielectric layer 12 coated over the first electrode 11 and the substrate 10, a partition 13 formed on the dielectric layer 12 for defining a discharge cell and preventing cross talk between the discharge cells, and a fluorescent layer 14 formed in a predetermined pattern inside the discharge space between the partitions 13.

A transparent front substrate 20 is installed atop the partition 13. Second and third electrodes 21 and 22 are formed on the lower surface of the front substrate 20 to be perpendicular to the direction of the first electrode 11. A dielectric layer 23 and a protective layer 24 are coated in sequence on the lower surfaces of the second and third electrodes 21 and 22 and the front substrate 20.

As a predetermined voltage is applied to each electrode, charges are accumulated in the dielectric layer 12. The accumulated charges trigger a discharge between the first and second electrodes 11 and 21 so that charged particles are formed on the lower surface of the dielectric layer 23 of the front substrate 16. When a predetermined voltage is applied to the second and third electrodes 21 and 22 in such a state, a sustaining discharge is generated. Thus, a plasma is formed in a charged gas layer in the discharge space. In the plasma, ultraviolet light is emitted and the fluorescent layer 14 excited by the ultraviolet light emits light.

During the operation of the plasma display panel as above, part of the ultraviolet light emitted by the gas discharge is absorbed by the front substrate 20 and the partition 13 where the fluorescent layer 14 is not formed. Also, part of the light emitted by the fluorescent layer 14 is dissipated into the dielectric layer 12 and the substrate 10 under the fluorescent layer 14, which does not affect brightness.

Plasma display panels introduced to solve the above problems are disclosed in U.S. Pat. No. 5,182,489 and Japanese Patent No. hey 5-80390.

FIG. 2 shows an example of a plasma display panel described in the above documents. Here, the same reference numerals as those in FIG. 1 indicate the same members. As shown in the drawing, a visual-ray reflection layer 16 having an upper surface processed with an insulation material is formed between a substrate 10 and a dielectric layer 12. The reflection layer 16 reflects the light proceeding toward the substrate 10 from a phosphor layer 14, toward a front substrate 20, to thus increase brightness. However, since the reflection layer 16 reflects only the visual ray emitted by the phosphor layer 14 and has a limit in reflecting ultraviolet light generated during gas discharge, a considerable improvement in the brightness cannot be expected. In particular, since the transmittance of the visual light of the phosphor layer 14 is extremely low, there is a limit to improving the brightness using the reflection layer 16.

SUMMARY OF THE INVENTION

To solve the above problems, it is an objective of the present invention to provide a plasma display panel having a reflection film for reflecting light rays that would be lost during the first light emission toward a fluorescent layer to be used in the second light emission in a discharge space.

Accordingly, to achieve the above objective, there is provided a plasma display panel including front and rear substrates coupled to face each other, a partition formed between the front and rear substrates to define a discharge space, a discharger for generating parent light rays by discharging gas filled in the discharge space, a fluorescent layer, formed in a predetermined pattern in the discharge space, for emitting light by being excited by the parent light rays, and a reflection film, formed in an area where the fluorescent layer is not formed in the discharge space, for reflecting the parent light rays toward the fluorescent layer.

In the present invention, it is preferable that the reflection film is formed by superimposing at least two transparent thin film layers different from each other.

Also, it is preferable that the thin film layer is formed of material including salt of groups 1A and 2A of the periodic table and that the thin film layer is formed of at least one material selected from the group consisting of MgO, LiF, $MgF_2$, $CaF_2$, $SrF_2$, and $BaF_2$.

Further, it is preferable that thickness of the thin film layer is set to $\lambda/4n \pm \lambda/16$ and $\lambda$ is the wavelength of the parent rays.

BRIEF DESCRIPTION OF THE DRAWINGS

The above objective and advantages of the present invention will become more apparent by describing in detail preferred embodiments thereof with reference to the attached drawings in which.

DETAILED DESCRIPTION OF THE INVENTION

Figure 1:
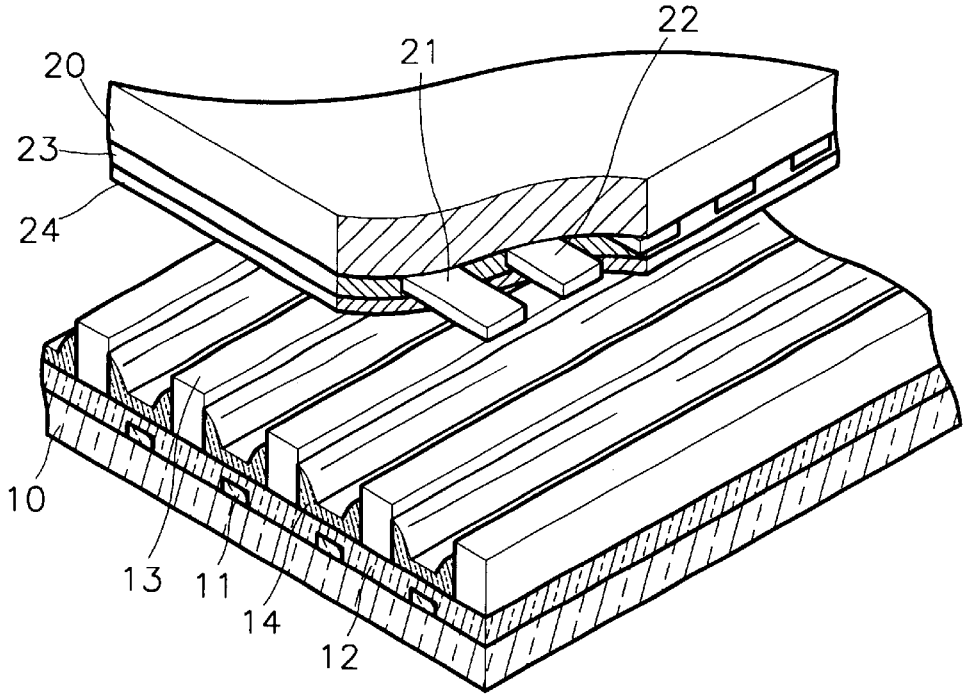
FIG. 1 (PRIOR ART)
FIG. 1 is a perspective view for illustrating a conventional plasma display panel.
Figure 2:
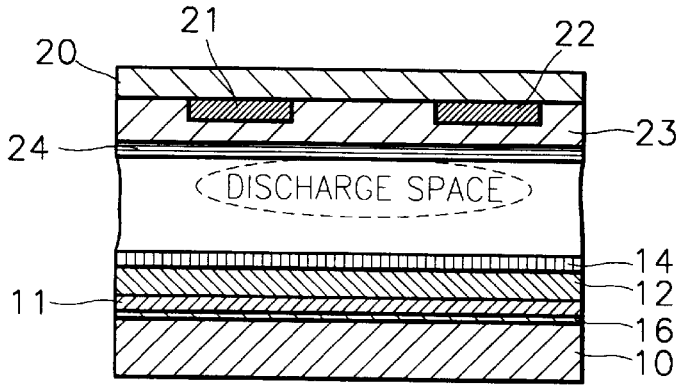
FIG. 2 (PRIOR ART)
FIG. 2 is a sectional view illustrating another conventional plasma display panel.
Figure 3:
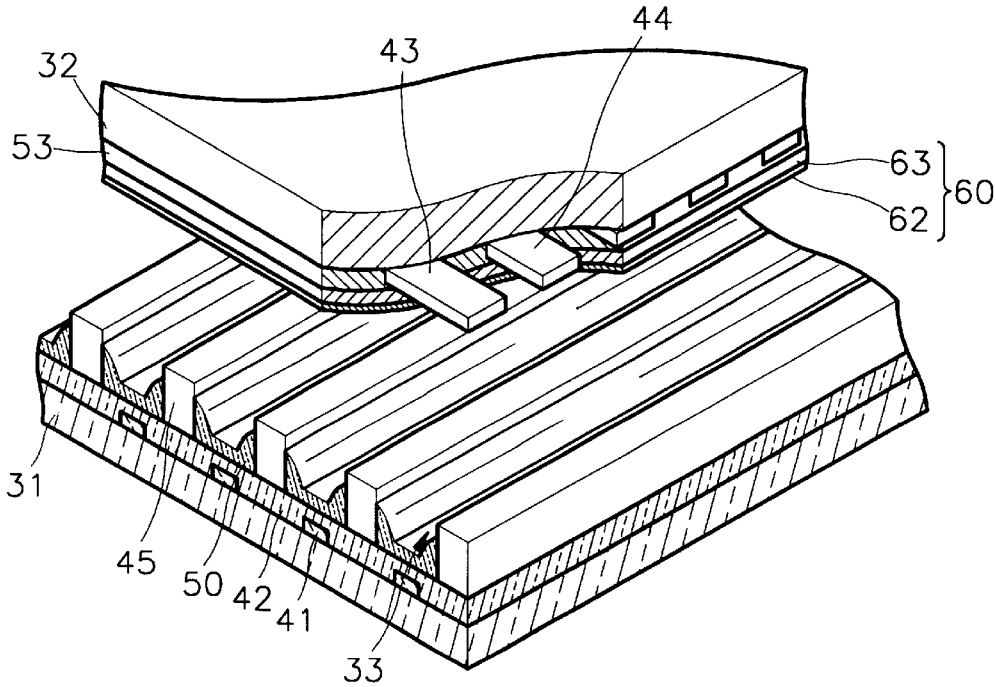
FIG. 3 is a perspective view for illustrating a plasma display panel according to a preferred embodiment of the present invention.
Figure 4:
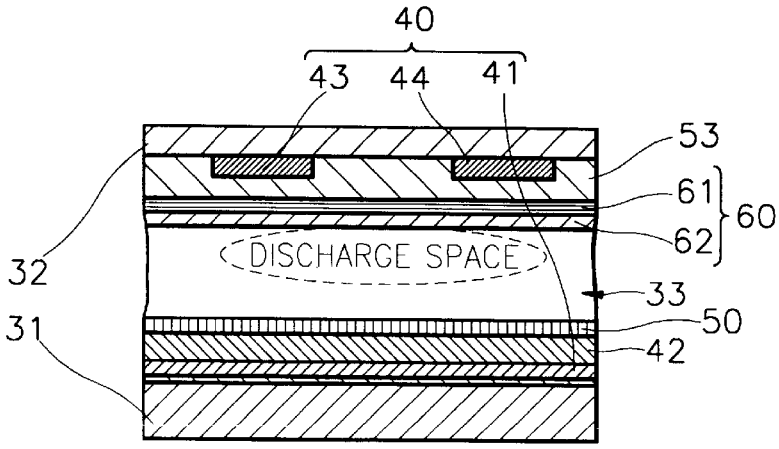
FIG. 4 is a sectional view of the plasma display panel shown in FIG. 3.

Referring to FIGS. 3 and 4, the plasma display panel according to a preferred embodiment of the present invention has a rear substrate 31 and a transparent front substrate 32 coupled to each other to be separated predetermined distance from each other. A discharge space 33 is formed between the rear and front substrates 31 and 32.

A discharge portion 40 for the first light emission which emits parent rays to be used in the second light emission is formed on the upper surface of the rear substrate 31 and the lower surface of the front substrate 32, respectively. In the specification, the "first light emission" means that ultraviolet light is emitted as gas is discharged at the initial stage of operation of the plasma display panel and the "second light emission" means emission of light as a fluorescent layer is excited by the ultraviolet light.

The discharge portion 40 includes first electrodes 41 formed in strips on the upper surface of the rear substrate 31, a dielectric layer 42 coated on the upper surface of the rear substrate 31 to encompass the first electrodes 41, second and third electrodes 43 and 44 formed on the lower surface of the front substrate 32 to be perpendicular to the direction of the first electrodes 41, and a dielectric layer 53 formed on the lower surface of the front substrate 32 to encompass the second and third electrodes 43 and 44. The discharge portion 40 is not limited by the present embodiment and any structure appropriate for generating glow discharge in the discharge space 33 is possible as the discharge portion 40.

A partition 45 for defining the discharge space 33 is formed between the rear substrate 31 and the front substrate 32. The partition 45 is formed between the first electrodes 41 on the upper surface of the dielectric layer 42, to be parallel to the first electrodes 41.

A fluorescent layer 50, in which the second light emission is generated, is formed in a predetermined pattern between the partitions 45. The fluorescent layer 50 is formed on the upper surface of the dielectric layer 42 and the side surfaces of the partitions 45. The position of the fluorescent layer 50 may vary according to the type of a plasma display panel, i.e., a reflection type or a transmission type.

According to the characteristic feature of the present invention, a reflection film 60 for reflecting the parent rays generated during the first light emission toward the fluorescent layer 50 is formed in an area where the fluorescent layer is not formed in the discharge space. That is, the reflection film 60 is formed in an area where the fluorescent layer is not formed on the lower surface of the dielectric layer 53 of the front substrate 32 and/or part of the side surfaces of the partitions 45.

The reflection film 60 comprises of at least two thin film layers 61 and 62 whose reflectivities are quite different from each other.

Each of the thin film layers 61 and 62 can be formed of at least one material selected from the group consisting of transparent MgO, LiF, $MgF_2$, $CaF_2$, $SrF_2$, and $BaF_2$ using salt of groups 1A and 2A of the periodic table, or sapphire and quartz crystal.

Particularly, the thin film layer 62 directly exposed to the discharge space is preferably formed of MgO which emits secondary electrons.

Figure 5:
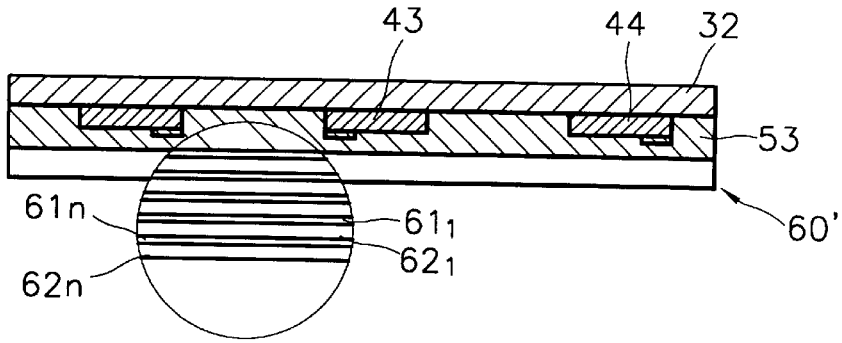
FIG. 5 is a sectional view of a plasma display panel according to another preferred embodiment of the present invention.

According to another preferred embodiment of the present invention, as shown in FIG. 5, a reflection film 60' is formed by alternately superimposing a plurality of first thin film layers $\mathbf{61}_1, \ldots, \mathbf{61}_n$ and second thin film layers $\mathbf{62}_1, \ldots, \mathbf{62}_n$, (wherein n equals the number of such layers) having different reflectivities. That is, each pair of first and second thin film layers $\mathbf{61}_1$ and $\mathbf{62}_1, \ldots, \mathbf{61}_n$ and $\mathbf{62}_n$ constitute a thin film layer unit and the reflection film 60' is formed by a plurality of superimposed thin film layer units.

Preferably, the first and second thin film layers $\mathbf{61}_1, \ldots, \mathbf{61}_n$ and $\mathbf{62}_1, \ldots, \mathbf{62}_n$ are formed of LiF and MgO, respectively, and there may be 2–10 thin film layer units.

Alternatively, the reflection film 60' is comprised of three thin film layer units, each unit being formed of a MgO layer and a LiF layer, and two or more thin film layer units whose unit is formed of a MgO layer and a $MgF_2$ layer.

Also, it is preferable that the thicknesses of the first and second thin film layers $\mathbf{61}_1, \ldots, \mathbf{61}_n$ and $\mathbf{62}_1, \ldots, \mathbf{62}_n$ are set to be $\lambda/4n \pm \lambda/16$ (here, $\lambda$ is the wavelength of parent light rays generated during the first light emission). The thickness and the number of superimposed layers are appropriately determined considering reflectivity and transmittance.

In FIG. 5, the same reference numerals as those of FIG. 4 indicate the same elements having the same functions.

Referring to FIGS. 3 through 5, in the operation of the plasma display panel of the present invention having the above structure, when AC voltage is applied to the first electrodes 41 and the second electrode 43, a preliminary discharge is generated and a sustaining discharge is generated between the second electrode 43 and the third electrode 44. Here, parent light rays, i.e., ultraviolet light, are generated and excite the fluorescent layer 50 to emit light. According to the present invention, since the reflection film 60 is formed inside the discharge space 33, the ultraviolet light emitted toward the area where the fluorescent layer 50 is not formed is reflected toward the fluorescent layer 50 by the reflection film 60 so that brightness in light emission can improve.

Figure 6:
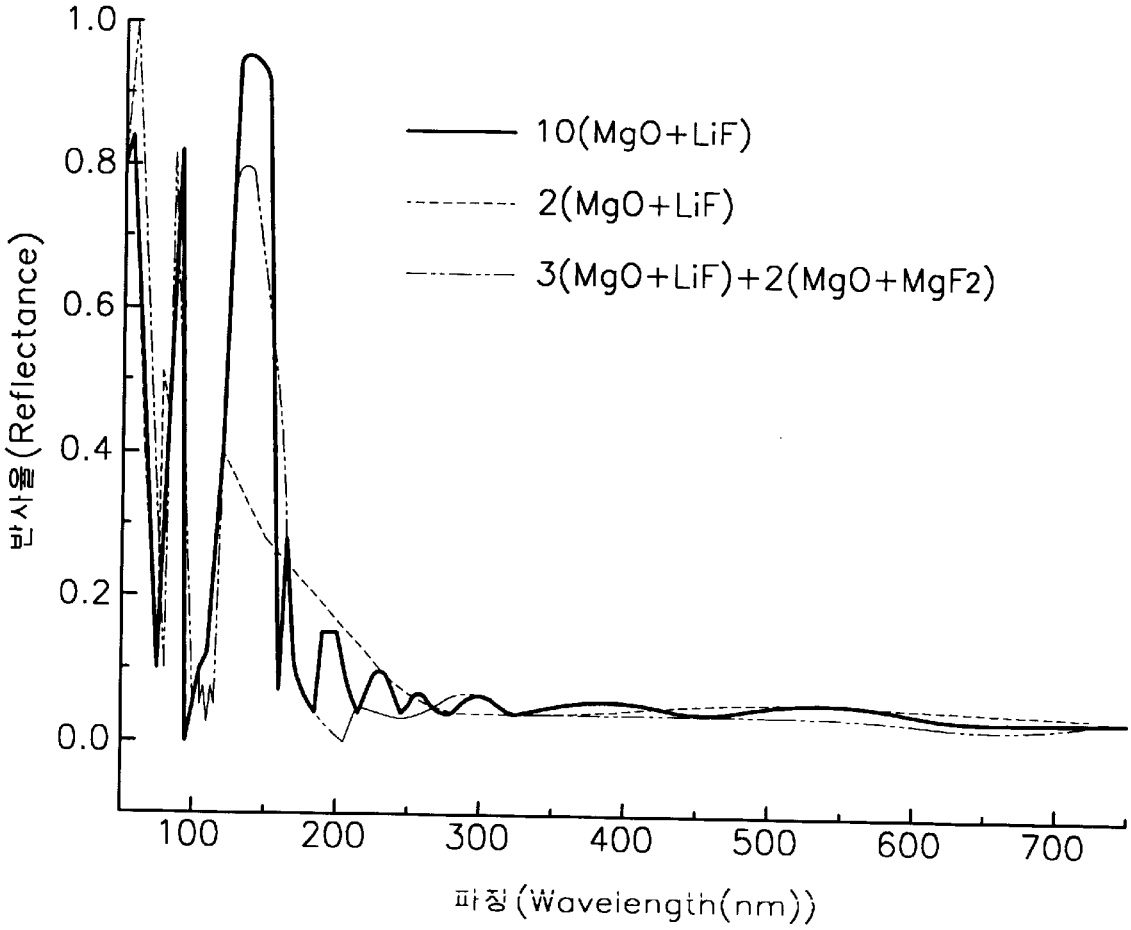
FIG. 6 is a graph showing the relationship between reflectance of the reflection film and wavelength of light.

Referring to FIG. 6 resulting from inventor's experiments, it can be seen that reflectance of ultraviolet light of 100–200 nm wavelength improves in the case that the reflection film constituted by ten thin film layer units of a MgO layer and a LiF layer (indicated by a solid line). Also, the graph shows that the reflectance of ultraviolet light of 100–200 nm wavelength in the case in which the reflection film comprises of three thin film layer units of a MgO layer and a LiF layer and two thin film layer units of a MgO layer and a $MgF_2$ layer (indicated by a double dotted line) is relatively higher than that in the case in which the reflection film comprises two thin film layer units of a MgO layer and a LiF layer (indicated by dotted line).

As described above, in the plasma display panel according to the present invention, brightness in light emission can be improved by reflecting ultraviolet light toward the fluorescent layer in a discharge space.

It is noted that the present invention is not limited to the preferred embodiment described above, and it is apparent that variations and modifications by those skilled in the art can be effected within the spirit and scope of the present invention defined in the appended claims.

What is claimed is:

1. A plasma display panel, comprising:

front and rear substrates coupled to face each other;

a partition formed between said front and rear substrates to define a discharge space;

discharge means for generating ultraviolet (UV) parent light rays by a discharging gas filled in said discharge space;

a fluorescent layer, formed in a predetermined pattern in said discharge space, for emitting light by being excited by said UV parent light rays;

a reflection film, formed in an area where said fluorescent layer is not formed in said discharge space, for reflecting said UV parent light rays toward said fluorescent layer;

wherein said reflection film is formed by superimposing at least two transparent thin film layers different from each other; and the thickness of said thin film layers is set to $(\lambda/4)n\pm\lambda/16$, where $\lambda$ is the wavelength of said UV parent rays, and n equals number of said thin film layers.

2. The plasma display panel as claimed in claim 1, wherein said thin film layer is formed of material including salt of groups 1A and 2A of the periodic table.

3. The plasma display panel as claimed in claim 2, wherein said thin film layer is formed of at least one material selected from the group consisting of MgO, LiF, $MgF_2$, $CaF_2$, $SrF_2$, and $BaF_2$.

4. The plasma display panel as claimed in claim 1, wherein said thin film layer of reflection film directly exposed to said discharge space is formed of material emitting secondary electrons.

5. The plasma display panel as claimed in claim 4, wherein said thin film layer exposed to said discharge space is formed of MgO.

* * * * *